US006875053B2

(12) United States Patent
Fujii et al.

(10) Patent No.: US 6,875,053 B2
(45) Date of Patent: Apr. 5, 2005

(54) GROUND CONNECTOR AND METHOD OF MOUNTING IT

(75) Inventors: Masayasu Fujii, Yokkaichi (JP); Toshikazu Sakurai, Yokkaichi (JP); Yukihiro Fukatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/730,824

(22) Filed: Dec. 8, 2003

(65) Prior Publication Data

US 2004/0115973 A1 Jun. 17, 2004

(30) Foreign Application Priority Data

Dec. 10, 2002 (JP) ..... 2002-357655

(51) Int. Cl.[7] ..... H01R 13/60
(52) U.S. Cl. ..... 439/567
(58) Field of Search ..... 439/92, 97, 939, 439/607, 567, 95

(56) References Cited

U.S. PATENT DOCUMENTS 3,998,517 A 12/1976 Griffin
4,006,872 A * 2/1977 Tanner ..... 248/27.1
4,313,646 A 2/1982 Millhimes et al.
4,579,405 A * 4/1986 Hirooka ..... 439/106
4,643,509 A * 2/1987 Hollyday et al. ..... 439/607
5,073,120 A 12/1991 Lincoln et al.
5,102,354 A * 4/1992 Crane et al. ..... 439/620
5,433,628 A 7/1995 Sadaishi et al.
5,645,455 A 7/1997 Seki
5,908,322 A 6/1999 Seki
2002/0009909 A1 1/2002 Kondoh

FOREIGN PATENT DOCUMENTS

JP 07-8976 2/1995

* cited by examiner

*Primary Examiner*—Phuong Dinh
(74) *Attorney, Agent, or Firm*—Gerald E. Hespos; Anthony J. Casella

(57) ABSTRACT

A joint connector (JC) has a ground terminal (50) mounted in a housing (30) so that a grounding plate (52) projects outside. The grounding plate (52) is fastened to a metal panel (80) by a nut (83) and bolt (87). A mount hole (85) of rectangular cross section is formed at a specified distance in a specified direction from the nut (83). A clip (70) is formed on the bottom of the housing (30) so that the positional relationship of the clip (70) and an insertion hole (53) of the grounding plate (52) corresponds to that of the mount hole (85) of the nut (83) of the metal panel (80). The housing (30) is mounted on the metal panel (80) by inserting the clip (70) into the mount hole (85). Thus, the insertion hole (53) of the grounding plate (52) is at a position aligned with the nut (83).

9 Claims, 12 Drawing Sheets

GROUND CONNECTOR AND METHOD OF MOUNTING IT

BACKGROUND OF THE INVENTION

1. Field of the Invention

The invention relates to a ground connector.

2. Description of the Related Art

Japanese Unexamined Utility Model Publication No. H07-8976 shows a ground joint connector with a housing. The housing has a connecting portion for receiving a mating connector and mating terminals. A ground terminal with terminal pieces projecting therefrom is mounted so that the respective terminal pieces project into the connecting portion and so that a grounding portion projects outside. The grounding portion is fixed to a grounding member, such as a metal panel. The mating terminals are connected with ends of wires for grounding. The mating connector that accommodates the mating terminals is fit to the connecting portion so that the wires can be grounded collectively.

An insertion hole is formed in the grounding portion, and a nut is secured to the metal panel. The nut is screwed down on a bolt inserted through the insertion hole to fasten the nut to the bolt. However, the insertion hole of the grounding portion has to be aligned with the nut of the metal panel before the bolt is fastened. This alignment may be difficult in some situations.

The invention was developed in view of the above problem and an object thereof is to improve the mounting operability of a ground connector.

SUMMARY OF THE INVENTION

The invention relates to a ground connector, and preferably a ground joint connector. The ground connector includes a housing and a ground terminal is mounted in the housing. The ground terminal is to be connected with a mating terminal and is mounted in the housing so that a grounding portion of the ground terminal projects outside. The grounding portion can be fixed to a grounding member by a screw. The housing comprises a positioning portion engageable with an engaging portion on the grounding member to position the housing so that the grounding portion substantially aligns with a specified fixing position of the grounding member. The grounding portion then is fastened by the screw.

The grounding portion can be positioned quickly and precisely before being fastened by the screw. As a result, the mounting efficiency of the ground connector is improved.

Engaged parts of the positioning portion and the engaging portion preferably have cross sections that will quickly and precisely position the grounding portion.

Engaged parts of the positioning portion and the engaging portion preferably have sufficient rigidity to prevent the housing from turning as the grounding portion is fastened by the screw. Thus, the housing need not be pressed to prevent turning, and the operation is easier.

The grounding member preferably is a metal panel and the positioning portion preferably is a clip capable of undetachably mounting the housing on the metal panel. The grounding portion can be positioned automatically as the housing is mounted on the metal panel by the clip.

The clip preferably comprises a base plate that has a width sufficient to fit tightly between sides of the engaging portion. The clip also preferably has a head that functions as a guide during insertion.

The clip preferably comprises resilient locking pieces formed behind the head as seen in a mating direction of the clip into the engaging portion. The resilient locking pieces are formed to diverge toward the housing.

The positioning portion preferably comprises pressing pieces that are pressed between the housing and the grounding member when the housing is mounted properly on the grounding member. The pressing pieces preferably are formed at the base side of the base plate and extend more outward than the resilient locking pieces. The pressing pieces preferably have a substantially arcuate convex shape substantially facing the housing.

The invention also relates to a method of mounting or assembling a ground connector. The method comprises providing a ground connector with a ground terminal to be connected with a mating terminal. The ground terminal is mounted in a housing so that a grounding portion projects outside. The method then includes engaging a positioning portion of the housing with an engaging portion on the grounding member to position the housing at a position for the grounding portion to align with a specified fixing position of the grounding member. The method further includes fixing the grounding portion to the grounding member, preferably by fastening with a screw.

The positioning portion and the engaging portion preferably are engaged in the engaging step to prevent the housing from turning as the grounding portion is fastened by the screw.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
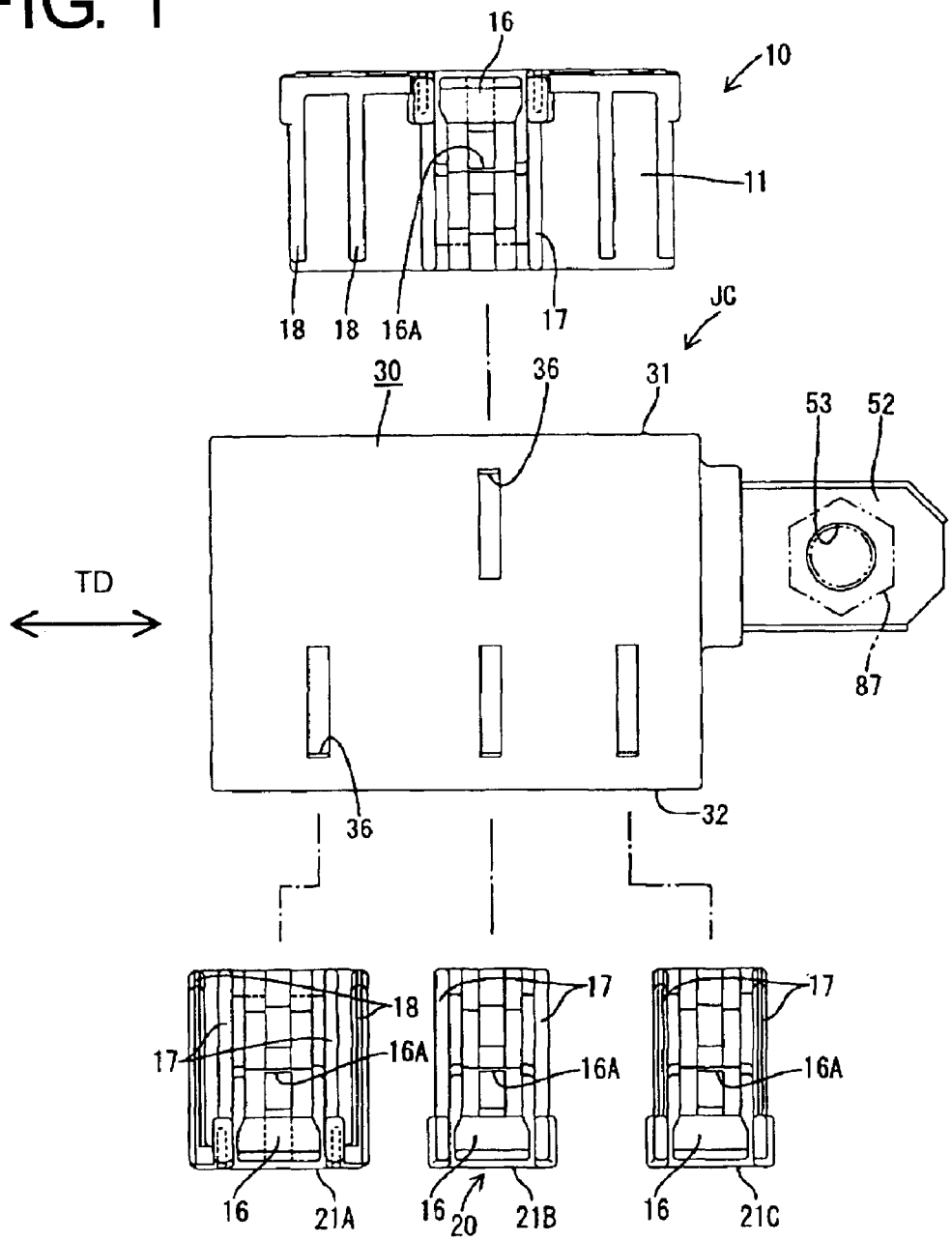
FIG. 1 is an exploded plan view showing a joint connector according to one embodiment of the invention and mating connectors.

A joint connector according to the invention is identified by JC in FIG. 1. A power-supply side connector 10 and electric-part side connectors 20 are connected with substantially opposite surfaces of the joint connector JC. The joint connector JC is mountable on a metal panel 80 as a grounding member.

Figure 3:
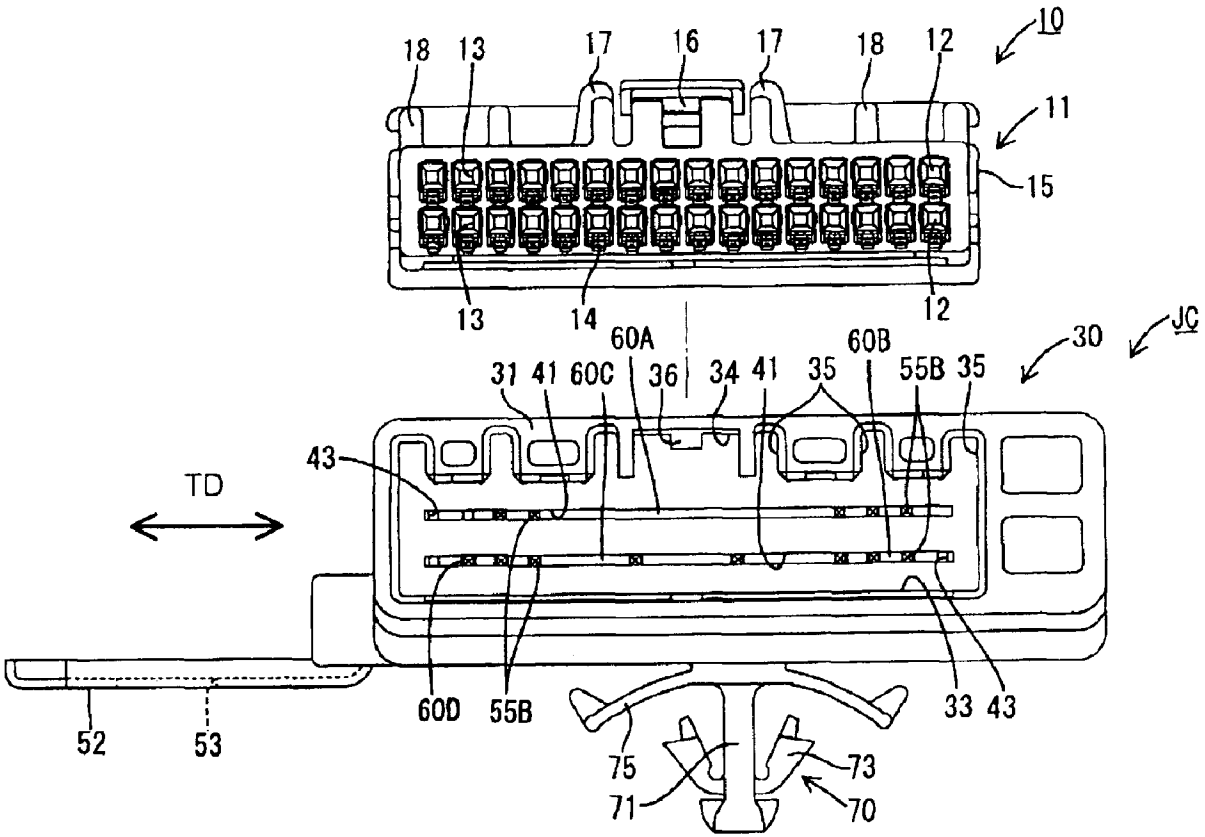
FIG. 3 is a rear view of the joint connector and a front view of a power-supply side connector.
Figure 4:
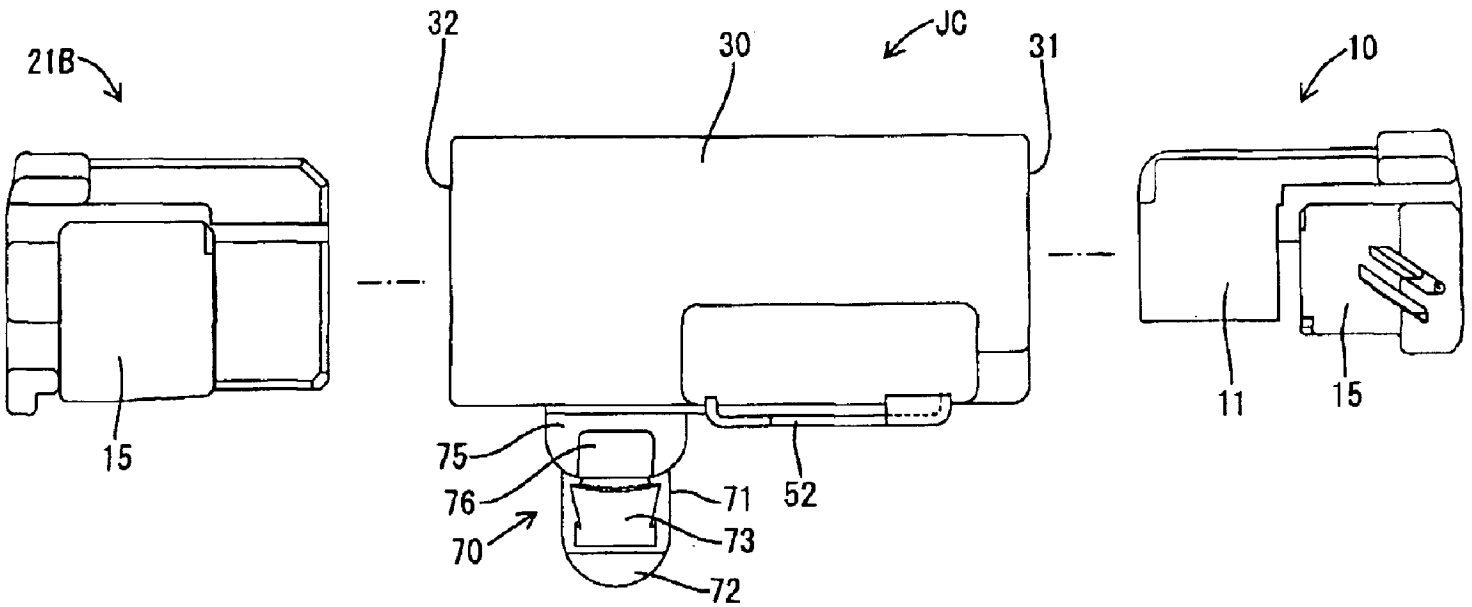
FIG. 4 is an exploded side view showing the joint connector and the mating connectors.
Figure 5:
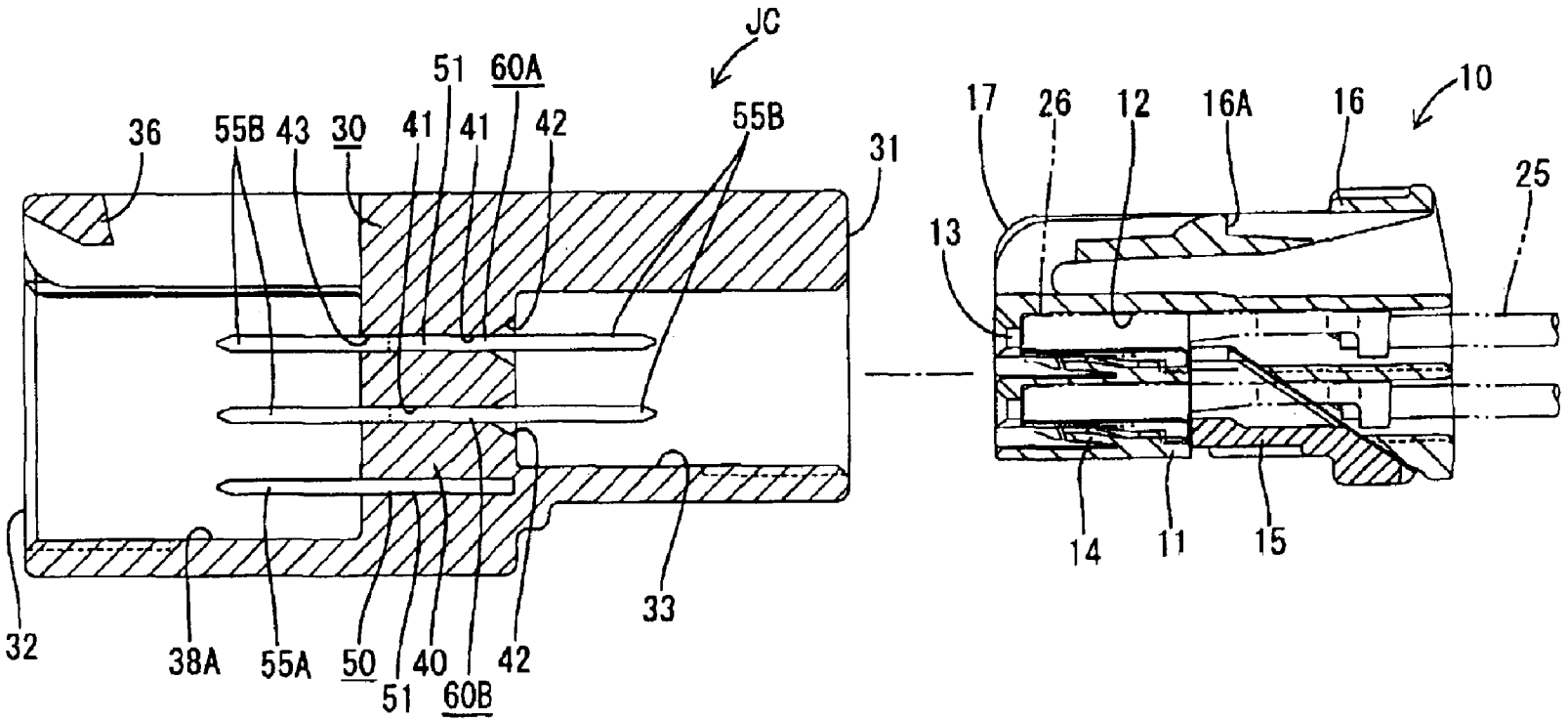
FIG. 5 is a section along 5—5 of FIG. 2 showing a state before the joint connector is connected with the mating connectors.

The power-supply side connector 10 has a power-supply side housing 11 made e.g. of a synthetic resin. The power-supply side housing 11 is a block with a wide rectangular cross section, as shown in FIGS. 3 and 5. Cavities 12 extend forward and backward at each of two levels in the power-supply side housing 11. A terminal insertion opening 13 is formed in the front mating side of each cavity 12.

Female terminals 26 secured to ends of wires 25 are inserted into the respective cavities 12 from behind (from right in FIG. 5), and are locked by locks 14 at bottom surfaces of the cavities 12 and by a retainer 15. Some of the cavities are empty and have no female terminal 26.

A lock arm 16 is at a widthwise middle of the upper surface of the power-supply side housing 11 between protection walls 17. Additionally, upside-down insertion preventing ribs 18 project from the upper surface.

The electric-part side connector 20 has three auxiliary connector housings, namely, a first auxiliary housing 21A, a second auxiliary housing 21B and a third auxiliary housing 21C, each of which is made of a synthetic resin.

Figure 2:
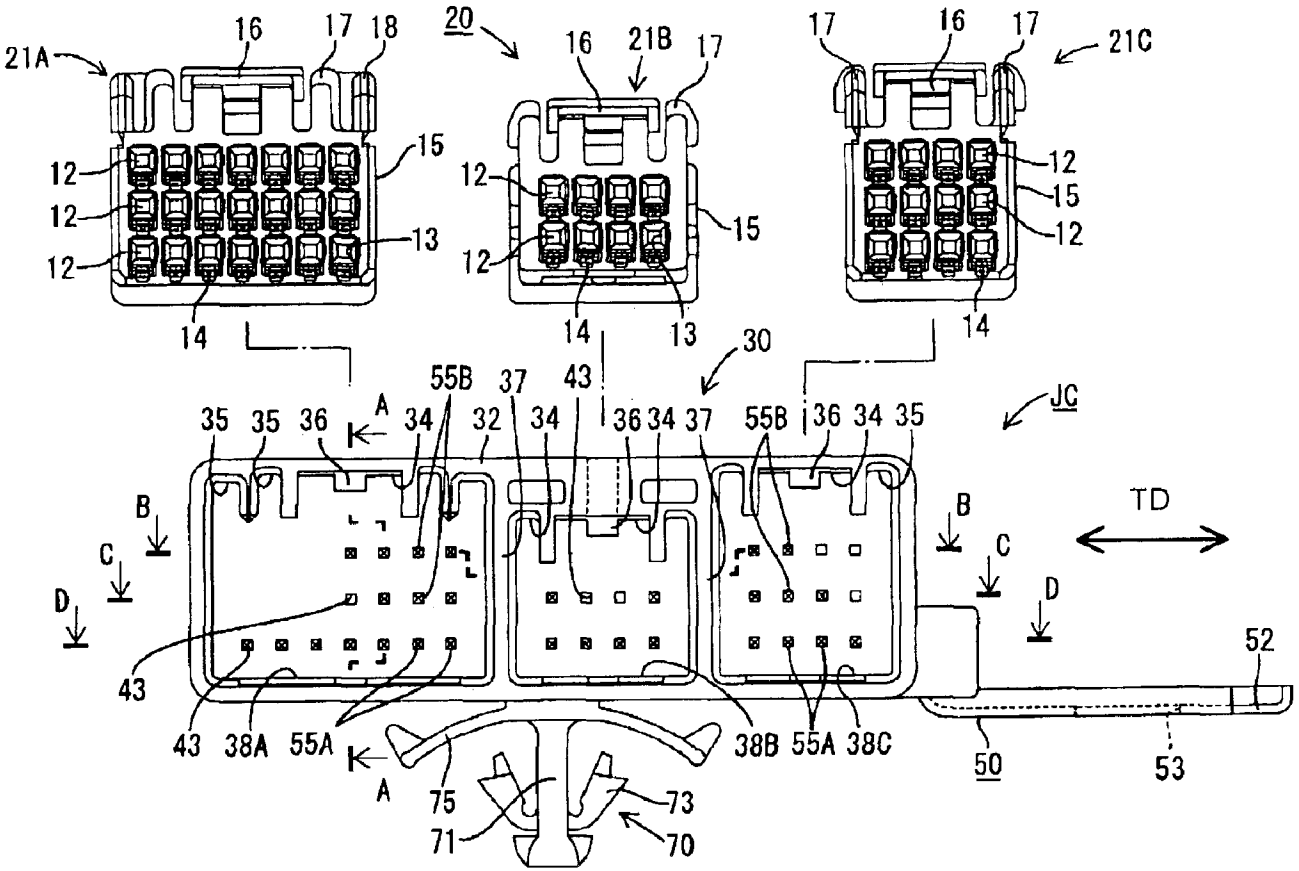
FIG. 2 is a front view showing the joint connector and an electric-part side connector.

As shown in FIG. 2, the first auxiliary housing 21A is substantially in the form of a block and is the largest of the three auxiliary housings 21A to 21C, and cavities 12 are formed at each of three levels therein. A terminal insertion opening 13 is formed in the front surface of each cavity 12 for receiving a tab 55A, 55B of a mating ground terminal 50 or a joint terminal 60. Although not shown in detail, female terminals 26 are secured to ends of wires 25 and are inserted into the cavities 12 and are locked doubly by locks 14 and a retainer 15. A lock arm 16 is disposed between protection walls 17 and upside-down insertion preventing ribs 18 are provided on the upper surface of the first auxiliary housing 21A.

The second auxiliary housing 21B is narrower and shorter than the first auxiliary housing 21A, and cavities 12 are formed at two levels therein for accommodating and doubly locking female terminals 26. A lock arm 16 is provided between protection walls 17 on the upper surface of the second auxiliary housing 21B.

The third auxiliary housing 21C has substantially the same height as the first auxiliary housing 21A, but a narrower width. Cavities 12 are formed at each of three levels in the third auxiliary housing 21C for accommodating and doubly locking female terminals 26. A lock arm 16 is provided between protection walls 17 on the upper surface of the third auxiliary housing 21C.

The joint connector JC has a housing 30 made e.g. of a synthetic resin. The housing 30 is a substantially flat block, and connecting surfaces 31, 32 are set on substantially opposite surfaces thereof for connection with the power-supply side connector 10 and the electric-part side connector 20. It should be understood that the connecting surfaces 31, 32 also may be arranged at an angle to each other, such as a right angle.

As shown in FIG. 3, a power-supply fitting recess 33 is formed in the connecting surface 31 for receiving the power-supply side housing 11. The ceiling surface of the power-supply side fitting recess 33A has a groove 34 for receiving the lock arm 16 of the power-supply side housing 11 and grooves 35 for receiving the protection walls 17 and the ribs 18 of the power-supply side housing 11. A lock 36 is formed in the groove 34, as shown in FIG. 5, for engaging a locking hole 16A in the lock arm 16.

Three electric-part side fitting recesses 38A, 38B, 38C are formed substantially side by side along the transverse direction TD in the connecting surface 32 and are partitioned by partition walls 37, as shown in FIG. 2. The first to third auxiliary housings 21A to 21C of the electric-part side connector 20 are fittable into the respective fitting recesses 38A, 38B, 38C.

Grooves 34, 35 are formed in ceiling surfaces of the fitting recesses 38A to 38C for receiving the lock arms 16, the protection walls 17 and the ribs 18 of the first to third auxiliary housings 21A to 21C. Similarly, locks 36 are formed in the grooves 34 for engaging locking holes 16A of the lock arms 16.

A thick intermediate wall 40 is formed between the back end surface of the fitting recess 33 and those of the fitting recesses 38A to 38C.

The ground terminal 50 and the joint terminals 60 are mounted at upper, middle and lower levels in the housing 30. The ground terminal 50 is to be mounted at a level different from the joint terminals 60.

Figure 8:
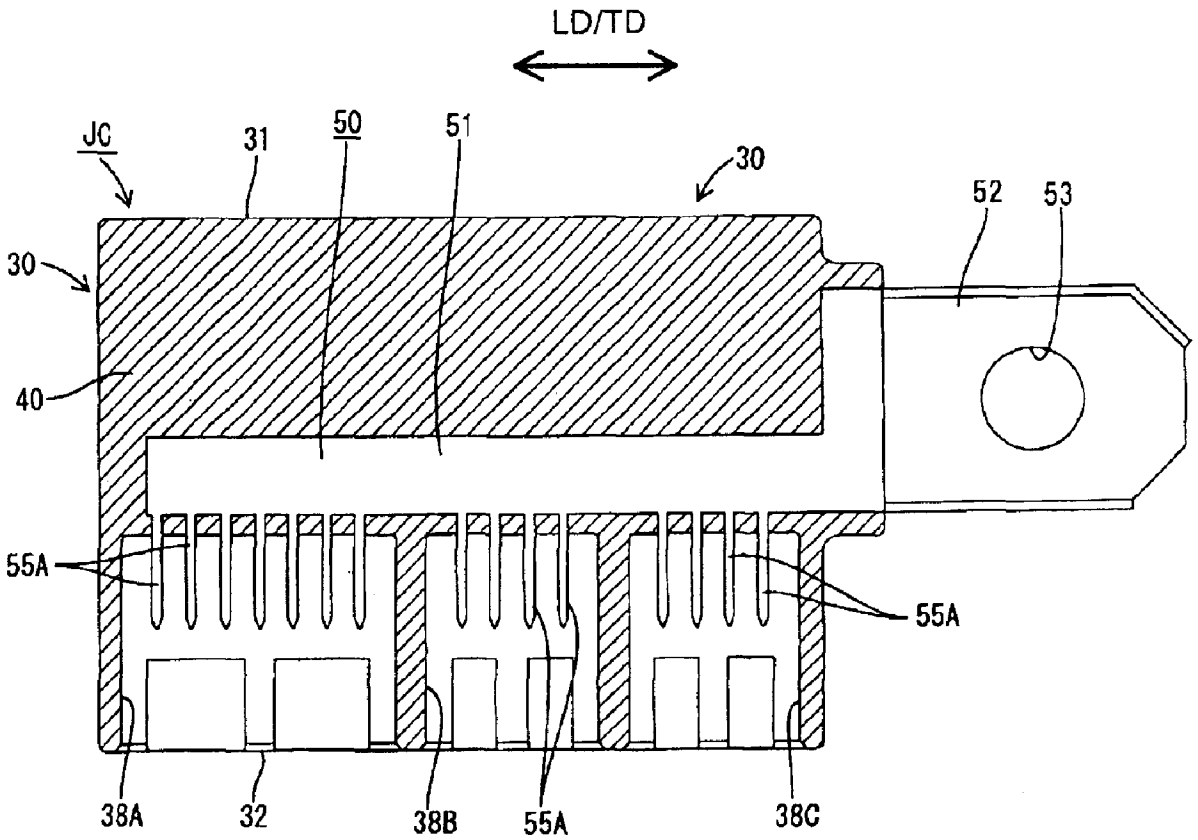
FIG. 8 is a section along 8—8 of FIG. 2.
Figure 9:
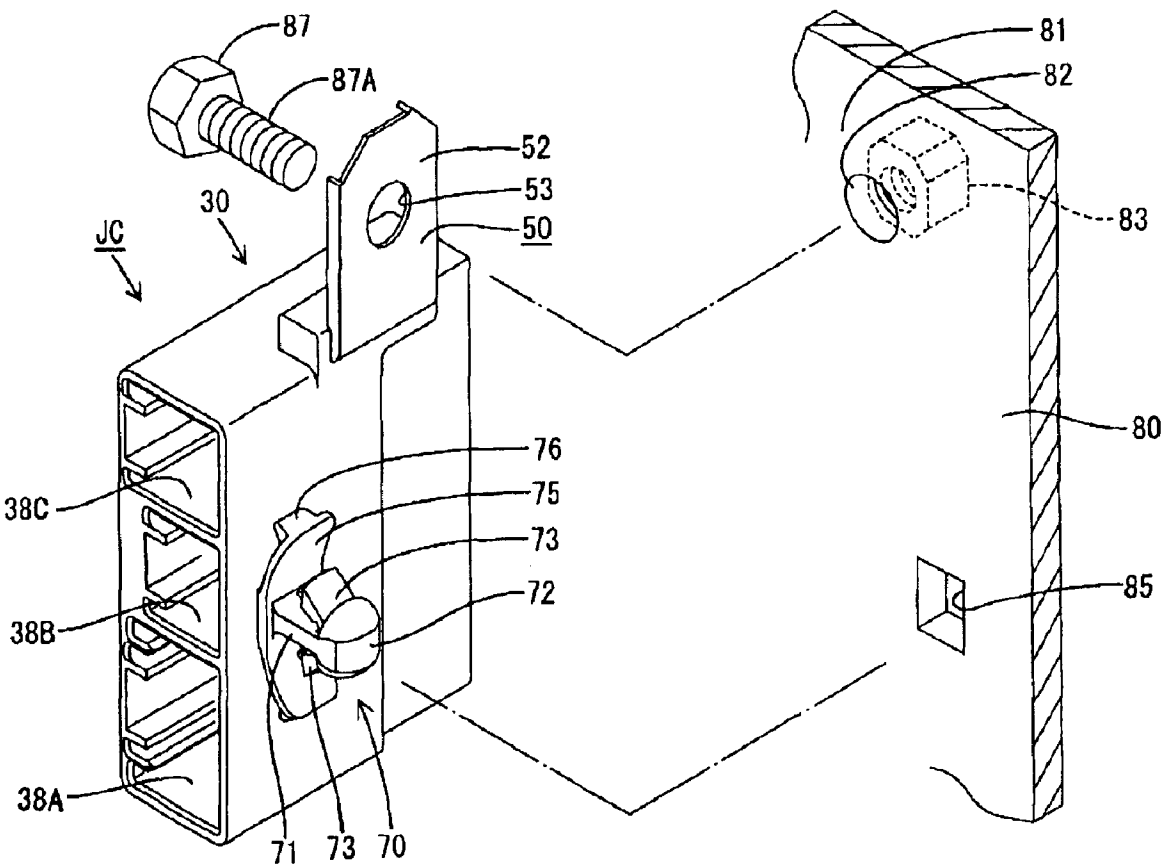
FIG. 9 is a perspective view showing a construction for mounting the connector housing on a metal panel.

The ground terminal 50 is mounted at the lower level. As shown in FIG. 8, the ground terminal 50 has a busbar 51 with a length substantially equal to the width of the housing 30, and a grounding plate 52 with an insertion hole 53 is formed unitarily at one end of the busbar 51 along the longitudinal direction LD thereof or the transverse direction TD, while being slightly lower as shown in FIG. 9.

Tabs 55A project substantially side by side from the lower edge of the busbar 51 in FIG. 8. More specifically, in the shown example seven, four and four tabs 55A are formed successively from the left side at the same intervals as the cavities 12 in the auxiliary housings 21A to 21C.

The ground terminal 50 is mounted in the housing 30 by insert molding. Specifically, the busbar 51 is embedded in the intermediate wall 40 and the grounding plate 52 projects out from a bottom end of one side surface of the housing 30 near the connecting surface 31 with the power-supply side connector 10. Further, the tabs 55A project into the fitting recesses 38A, 38B, 38C at bottom positions of the respective back surfaces of the fitting recesses 38A, 38B, 38C.

The joint terminals 60 are mounted at the upper and middle levels. Hereinafter, the reference numeral 60 is used for referring to the joint terminals collectively, whereas suffixes "A to D" are used with the reference numeral 60 when they are described individually.

Figure 6:
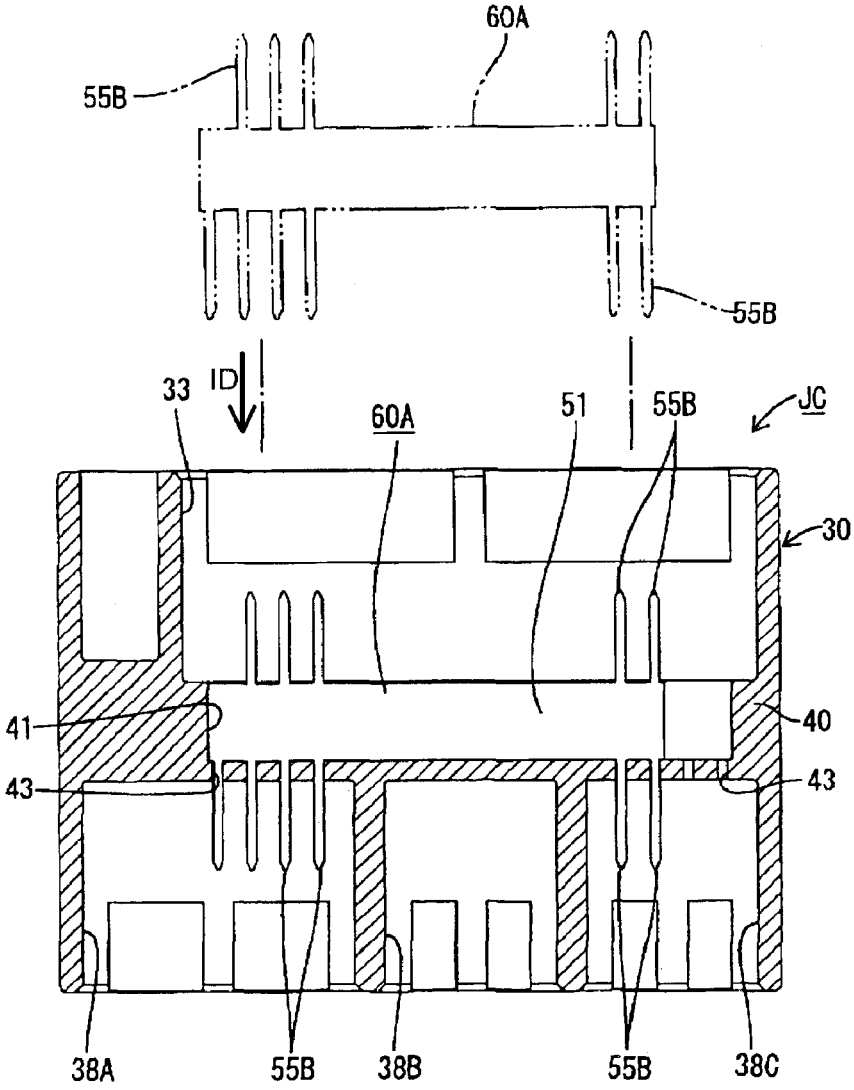
FIG. 6 is a section along 6—6 of FIG. 2.
Figure 7:
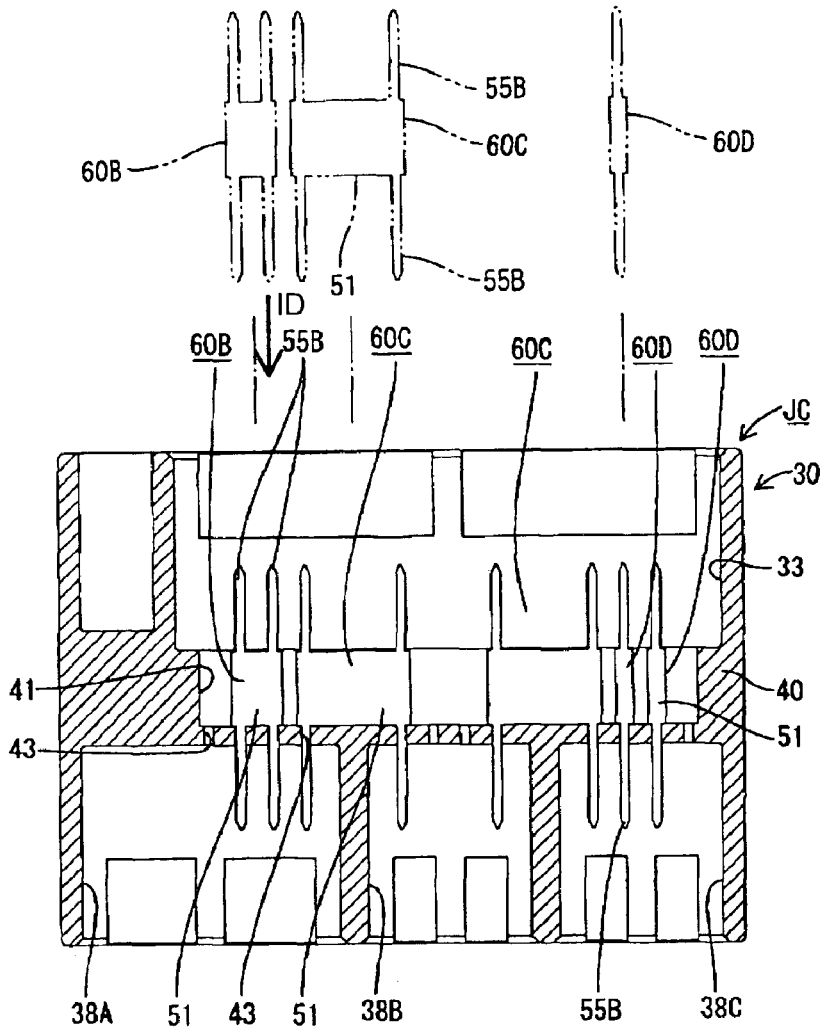
FIG. 7 is a section along 7—7 of FIG. 2.

The joint terminal 60 has tabs 55B that project in a specified arrangement from each of the opposite lateral edges of a busbar 51. A plurality of joint terminals 60 having busbars 51 of different lengths are formed. For example, the joint terminal 60A mounted at the upper level is a unitary piece having the narrow and long busbar 51 as shown in FIG. 6. On the other hand, five joint terminals 60B, 60C, 60D in three kinds having the busbars 51 of different shorter lengths are mounted at the middle level as shown in FIG. 7.

The joint terminals 60 are mounted in the housing 30 by pressing. Thus, insertion grooves 41 are formed at upper and middle positions in the surface of the intermediate wall 40 substantially corresponding to the back surface of the power-supply side fitting recess 33 for closely receiving the joint terminals 60, as shown in FIGS. 3 and 5. Each insertion groove 41 stretches over substantially the entire width of the power-supply side fitting recess 33 and has a closed back end and a depth so that the busbar 51 can be accommodated exactly therein. A guide 42 widened toward the front end is formed at the entrance of each insertion groove 41.

Press-in holes 43 are formed at the closed ends of the insertion grooves 41 for pressed insertion of the tabs 55B of the joint terminals 60. The press-in holes 43 are formed at all possible positions for the tabs 55B.

The joint connector JC is mountable on the metal panel 80, which may be aligned vertically in a vehicle, as shown in FIG. 9.

Figure 10:
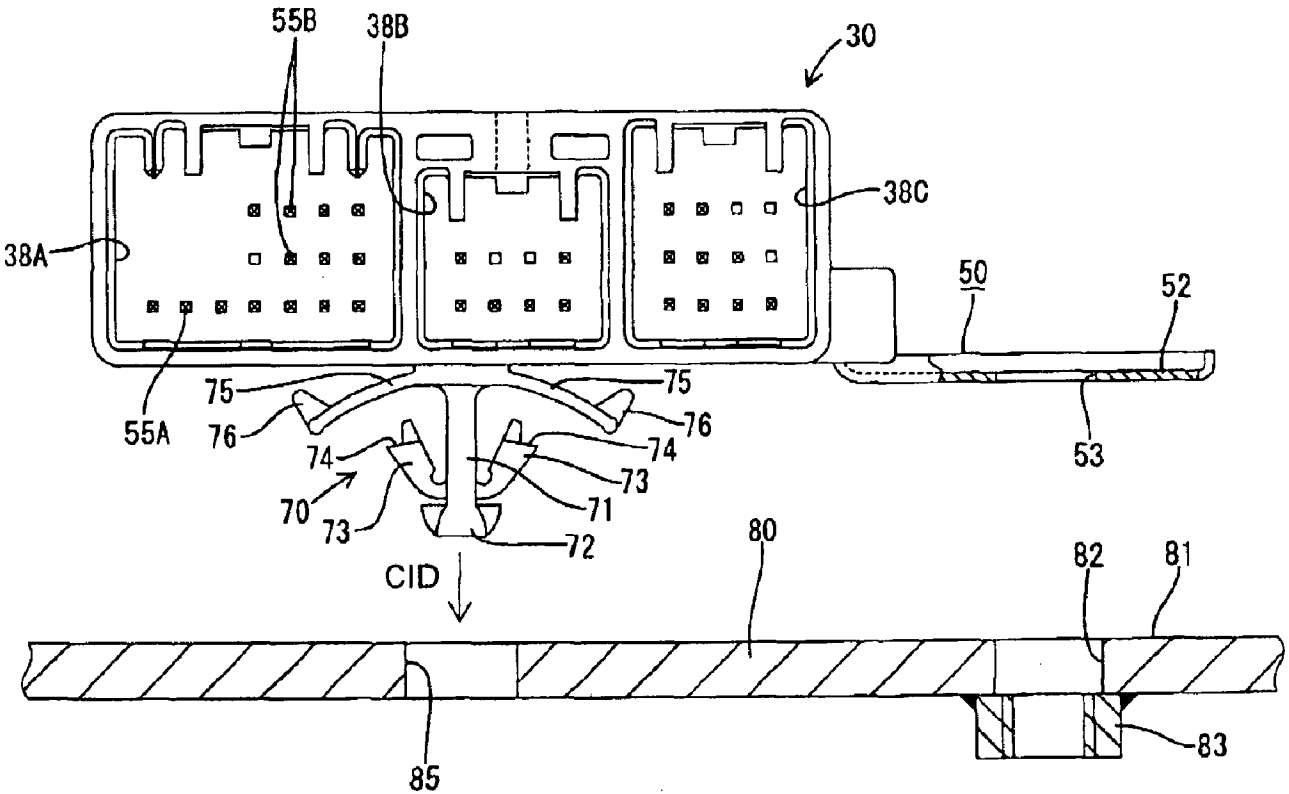
FIG. 10 is a front view partly in section showing a mounting operation of the connector housing.

The grounding plate 52 of the ground terminal 50 is to be mounted at a specified position on the front mounting surface 81 of the metal panel 80. A round through hole 82 is formed in the mounting surface 81 and a nut 83 is fixed to the rear surface preferably by welding, as shown in FIGS. 9 and 10.

A substantially rectangular mount hole 85 for a clip 70 is formed in the metal panel 80 at a position spaced in a specified direction from the through hole 82 by a specified distance.

A clip 70 is formed unitarily formed on a lateral surface of the housing 30 of the joint connector JC. More specifically, the clip 70 is formed so that the positional relationship of the clip 70 and the insertion hole 53 of the grounding plate 52 substantially corresponds to the positional relationship of the mount hole 85 and the through hole 82 of the metal panel 80.

The clip 70 has a thick base plate 71 with a width for tight fitting between the two opposite longer sides of the mount hole 85. A head 72 is provided at the projecting end of the base plate 71 and functions as a guide during insertion. The base plate 71 has a shape that is complementary to the shape of the mount hole 85 so that the base plate 71 cannot rotate or pivot in the mount hole 85.

Two resilient locking pieces 73 are formed behind (above in FIG. 10) the head 72 as seen in an inserting direction of the clip 70 into the mount hole 85. The resilient locking pieces 73 diverge toward the bottom surface of the housing 30, and locking steps 74 are formed at the leading ends of the resilient locking pieces 73 for engagement with the rear sides of the mount hole 85 at the opposite shorter sides.

Two pressing pieces 75 are formed at the base side of the base plate 71. The pressing pieces 75 align with the resilient locking pieces, but extend further than the resilient locking pieces 73. The pressing pieces 75 have convex arcuate surfaces facing towards the housing 30. Protrusions 76 are formed near the leading ends of the convex surfaces of the pressing pieces 75.

The ground terminal 50 of the joint connector JC is mounted into the housing 30 by insert-molding, as described above. Tabs 55A of the ground terminal 50 project into the three fitting recesses 38A, 38B, 38C at bottom positions of the respective back surfaces of the fitting recesses 38A, 38B, 38C, as shown in FIGS. 5 and 8. Further, the grounding plate 52 projects outward from the one side surface of the housing 30.

On the other hand, the joint terminals 60 are mounted later into the housing 30. A plurality of kinds of joint terminals 60 are prepared in advance and have busbars 51 of different lengths and/or different arrangements of the tabs 55B projecting from the opposite edges of the busbars 51 so as to, substantially correspond to joint patterns.

The joint terminal 60A for the upper level is a unitary that piece is inserted into the upper insertion groove 41 in the back surface of the power-supply side fitting recess 33, as shown in FIG. 6. The tabs 55B face forward with respect to inserting direction ID and are pressed into the press-in holes 43 at an intermediate stage of the insertion. The joint terminal 60A stops being pushed when the busbar 51 contacts the closed end of the insertion groove 41. Thus, the tabs 55B of the joint terminals 60A project in specified arrangements at the upper positions of the back surfaces of the power-supply side fitting recess 33 and the back surfaces of the three fitting recesses 38A, 38B, 38C in the electric-part side connecting surface 32 as shown in FIGS. 5 and 6.

The shorter joint terminals 60B to 60D are inserted into the insertion groove 41 at the middle level from the power-supply side fitting recesses 33 as shown in FIG. 7. The tabs 55B face forward with respect to the inserting direction ID and are pressed into the press-in holes 43. The joint terminals 60B to 60D stop being pushed when the busbars 51 contact the closed end of the insertion groove 41. Thus, the tabs 55B of the respective joint terminals 60B to 60D project in specified arrangements at the middle positions of the back surfaces of the power-supply side fitting recess 33 and the back surfaces of the three fitting recess 38A, 38B, 38C formed in the electric-part side connecting surface 32, as shown in FIGS. 5 and 7.

The assembled joint connector JC has a ground joint connector formed by the lower level and an intermediate connector formed by the upper and middle levels.

The joint connector JC is mounted on the metal panel 80 by inserting the base plate 71 of the clip 70 into the mount hole 85, as indicated by an arrow CID in FIG. 10 while the grounding plate 52 of the ground terminal 50 faces up. The resilient locking pieces 73 of the clip 70 resiliently deform to narrow the spacing therebetween during insertion into the mount hole 85. The pressing pieces 75 press against the front surface of the metal panel 80 as the clip 70 is pushed in. Thus, the resilient pieces 75 resiliently deform and at least partly flattened while laying the protrusions 76 substantially in a flattening direction.

Figure 11:
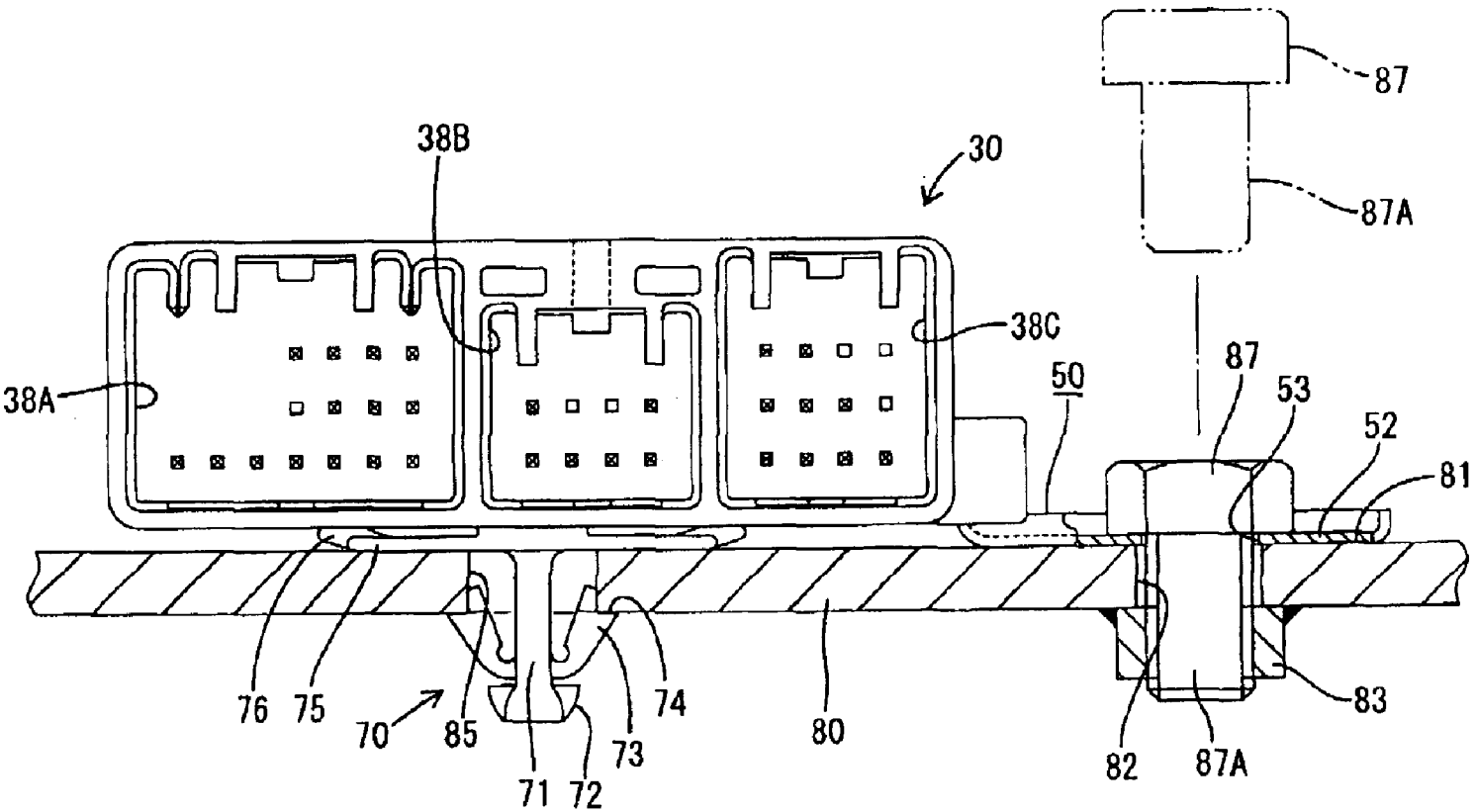
FIG. 11 is a front view partly in section showing a completely mounted state.

The clip 70 is pushed until the pressing pieces 75 are held substantially flat between the bottom surface of the housing 30 and the front surface of the metal panel 80 shown in FIG. 11. Thus, the locking steps 74 of the resilient locking pieces 73 pass the mount hole 85 and reach the rear surface of the metal panel 80. As a result, the resilient locking pieces 73 are restored resiliently to engage the locking steps 74 with the shorter sides of the mount hole 85. A portion of the metal panel 80 near the mount hole 85 is held tightly by the pressing pieces 75 and the resilient locking pieces 73 at the front and rear sides due to the resilient forces of the pressing pieces 75 including the protrusions 76. Accordingly, the clip 70 and the housing 30 are mounted on the metal panel 80 so as not to come out and not to turn.

The insertion hole 53 of the grounding plate 52 of the ground terminal 50 is aligned substantially concentrically with the through hole 82 of the metal panel 80 and the nut 83 when the housing 30 is positioned and mounted in the manner described above. Then, a shaft 87A of a bolt 87 is inserted through the insertion hole 53 of the grounding plate 52 and the through hole 82 for threaded engagement with an internal thread of the nut 83. The bolt 87 is fastened by a torque wrench so that the grounding plate 52 is fixed to the mounting surface 81 of the metal panel 80. Thus, an electrical connection is established.

The mating connectors are connected with the joint connector JC after the joint connector JC is mounted on the metal panel 80. For example, the power-supply side connector 10 is fit into the power-supply side fitting recess 33 and locked therein by the engagement of the lock 36 with the locking hole 16A of the lock arm 16. The female terminals 26 in the power-supply side connector 10 are connected with the corresponding tabs 55B of the joint terminals 60 projecting from the back surface of the power-supply side fitting recess 33.

The first to third auxiliary housings 21A to 21C of the electric-part side connector 20 are fit successively into the respective fitting recesses 38A, 38B, 38C in the power-supply side connecting surface 32 and are locked therein. The female terminals 26 in the respective auxiliary housings 21A to 21C then are connected with the corresponding tabs 55A of the ground terminal 50 or the corresponding tabs 55B of the joint terminals 60 projecting from the back surfaces of the fitting recesses 38A 38B, 38C.

When the mating connectors are connected in this way, the female terminals 26 arranged at the lower levels of the respective auxiliary housings 21A to 21C of the electric-part side connector 20 and the wires 25 connected therewith are grounded via the ground terminal 50.

Further, the wires 25 introduced into the power-supply side connector 10 and the wires 25 introduced to the upper two levels of the respective auxiliary housings 21A to 21C of the electric-part side connector 20 are jointed in a specified pattern via the joint terminals 60 at each level.

Upon a change in the joint pattern, a joint terminal corresponding to a new pattern may be prepared separately and pressed into the insertion groove 41 in the housing 30 in the manner described above.

As described above, the housing 30 is mounted on the metal panel 80 by inserting the clip 70 on the housing 30 into the mount hole 85. Thus, the housing 30 is positioned and fixed at a position where the insertion hole 53 of the grounding plate 52 aligns with the nut 83. Thus, the bolt 87 can be fastened immediately and the mounting operability of the joint connector JC is improved.

The clip 70 in the mount hole 85 prevents the housing 30 from turning during the fastening of the bolt 87. Therefore, the housing 30 need not be pressed to prevent turning, thereby making the operation easier.

Figure 12:
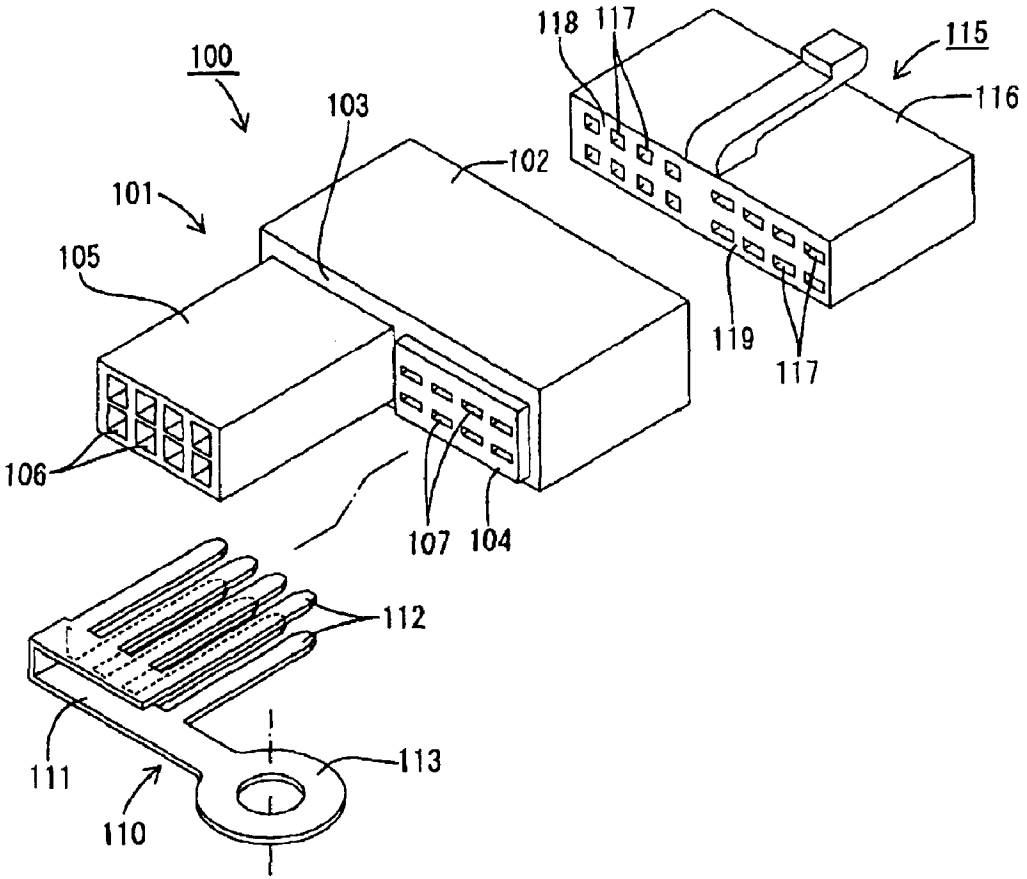
FIG. 12 is a perspective view of a reference example to which the invention is applicable.

FIG. 12 shows an alternate ground joint connector 100 with a male housing 101 that has a wide receptacle 102. The rear surface of the receptacle 102 is divided into a harness area 103 and a grounding area 104. A tower 105 formed with cavities 106 at upper and lower levels is to be coupled to the harness area 103. Male terminals (not shown) to be secured to ends of wiring harnesses are accommodated in the respective cavities 106 so that tabs thereof project into the receptacle 102.

Terminal insertion openings 107 are formed at upper and lower levels in the grounding area 104. Further, a ground terminal 110 is prepared with a busbar 111 that is folded back to have upper and lower sections. Tabs 112 project in a row from one edge of each of the upper and lower sections, and a round grounding plate 113 with a hole is formed at an end of the lower section of the busbar 111. The ground terminal 110 is mounted in the grounding area 104 so that the tabs 112 project into the receptacle 102 through the terminal insertion openings 107 and the grounding plate 103 projects sideways.

A mating connector 115 has a female housing 116 that can fit into the receptacle 102 of the male housing 101. The female housing 116 is formed with cavities 117 into which corresponding female terminals (not shown) secured to ends of wiring harnesses are insertable. The cavities 117 are arranged at upper and lower levels. The left side of the mating connector 115 when viewed from the front is a harness area 118, whereas the right side thereof is a grounding area 119.

The ground joint connector 100 is used, for example, by fixing the grounding plate 113 of the mounted ground terminal 110 to a grounding member such as a metal panel by a fastening means such as a bolt.

The male and female housings 101, 116 are connected so that the female terminals in the harness area 118 of the female housing 116 connect with the corresponding male terminals in the harness area 103 of the male housing 101. Additionally, the female terminals in the grounding area 119 of the female housing 116 connect with the corresponding tabs 112 of the ground terminal 110 and the wires connected with the female terminals in the grounding area 119 are grounded via the ground terminal 110.

The present invention is similarly applicable to the ground joint connector 100 as above by providing the male housing 101 with a clip as described with reference to FIGS. 1 to 11.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

If attention is paid only to the positioning of the housing, a plurality of pins projecting from the metal panel may be fit into mount holes in the metal panel or a pin having a modified cross section and projecting from the metal panel may be fit into a mount hole having the same cross section instead of using the clip of the foregoing embodiment.

One round pin could project from the housing. The grounding plate and the nut then can be brought into alignment by turning the metal panel about the round pin. Such an embodiment also is within the scope of the invention.

A stud bolt on the metal panel may be introduced through the insertion hole of the grounding plate and fastened by a nut for fixing the grounding plate to the metal panel according to the invention.

An assembling order may be set arbitrarily so that, for example, the joint connector is first connected with the mating connectors and the grounding plate is finally mounted on the metal panel.

A ground joint connector with a function of an intermediate connector is illustrated in the foregoing embodiment. However, the ground joint connector may be used singly without having such a function.

Even though the invention has been described with reference to a ground joint connector, it should be understood that the invention is also applicable to other ground connectors different from ground joint connectors.

What is claimed is:

1. A ground connector in which a ground terminal to be connected with a mating terminal is mounted in a housing so that a grounding portion projects outside the housing, the grounding portion being fixable to a metal grounding panel by a fastening screw, the grounding panel having a non-round engaging hole formed therein and a fixing hole spaced from the non-round engaging hole, wherein the housing comprises a positioning portion engageable with an non-round engaging hole on the metal grounding panel, the positing portion being configured relative to the non-round engaging hole to resist rotation and translation of the housing relative to the panel and to position the housing at a position so that the grounding portion is substantially aligned with a specified fixing hole of the metal grounding panel.

2. The ground connector of claim 1, wherein engaged parts of the positioning portion and the non-round engaging having have cross sections for substantially aligning the grounding portion with the fixing position.

3. The ground connector of claim 1, wherein engaged parts of the positioning portion and the non-round engaging hole are substantially rectangular and have a sufficient rigidity to prevent the housing from turning as the grounding portion is fastened by the screw.

4. A ground connector in which a ground terminal to be connected with a mating terminal is mounted in a housing so that a grounding portion projects outside the housing, the grounding portion be fixable to a metal grounding panel by a fastening screw, wherein the housing comprises a positioning portion engageable with an engaging portion on the metal grounding panel to position the housing at a position so that the grounding portion is substantially aligned with a specified fixing position of the metal grounding panel, the positioning portion comprising a clip with a base plate having a width for closely fitting between sides of the engaging portion and a head on a projecting end of the base plate for guiding the base plate during insertion, resilient locking pieces being formed behind the head as seen in a mating direction of the clip into the engaging portion, the resilient locking pieces diverging from one another at positions closer to the housing, and dressing pieces between the housing and the metal grounding panel when the housing is mounted properly on the metal grounding panel wherein the pressing pieces have an arcuate convex shape substantially facing the housing.

5. A ground connector for mounting to a ground panel having a substantially round fixing position and a non-round engaging hole spaced from the fixing position, comprising:

a housing;

a ground terminal mounted in the housing along an inserting direction, the ground terminal having a grounding portion projecting outside the housing and configured for engagement with the fixing position of the ground panel; and a non-round positioning portion on the housing spaced from the grounding portion, the positioning portion being disposed and configured for mating with the engaging hole on the ground panel and aligning the housing so that the grounding portion aligns with the fixing position of the ground panel, the positioning portion comprising a base projecting from the housing transverse to the inserting direction of the ground terminal, the base having a non-round cross section for closely engaging two opposed surfaces of the engaging hole, resilient locking pieces projecting from the base and configured for resiliently engaging third and fourth opposed surfaces of the engaging hole and for engaging a first side of the ground panel, and pressing pieces projecting from the base between the housing and the resilient locking pieces, the pressing pieces being configured such that the ground panel is held securely between the resilient locking pieces and the dressing pieces.

6. The ground connector of claim 5, wherein the clip comprises a rounded head on a projecting end of the base for guiding the base into engagement with the engagement portion.

7. The ground connector of claim 6, wherein the locking pieces project from the base between the head and the housing and diverge towards the housing.

8. The ground connector of claim 5, wherein, the pressing pieces are configured for curving away from the housing and being resiliently deflectable towards the housing when the housing is mounted properly on the ground panel.

9. The ground connector of claim 8, wherein the pressing pieces project further from the base than the resilient locking pieces.

* * * * *